United States Patent [19]

Evans et al.

[11] 4,319,249

[45] Mar. 9, 1982

[54] METHOD AND ANTENNA FOR IMPROVED SIDELOBE PERFORMANCE IN DIPOLE ARRAYS

[75] Inventors: Gary E. Evans, Baltimore; William F. Hoover, Jr., Hanover, both of Md.

[73] Assignee: Westinghouse Electric Corp., Pittsburgh, Pa.

[21] Appl. No.: 116,701

[22] Filed: Jan. 30, 1980

[51] Int. Cl.[3] ..... H01Q 1/52; H01Q 21/06

[52] U.S. Cl. ..... 343/703; 343/795; 343/815; 343/822

[58] Field of Search ..... 343/795, 815, 816, 822, 343/703, 854

[56] References Cited

U.S. PATENT DOCUMENTS

| | | | |
|---|---|---|---|
| 2,844,818 | 7/1958 | Alford | 343/815 |
| 2,860,339 | 11/1958 | Kandoian | 343/795 |
| 2,973,517 | 2/1961 | Watts | 343/795 |
| 3,114,913 | 12/1963 | Alford | 343/795 |
| 3,681,770 | 8/1972 | Alford | 343/815 |

*Primary Examiner*—Eli Lieberman

*Attorney, Agent, or Firm*—H. W. Patterson

[57] ABSTRACT

The existence and method of suppression of spurious post mode to improve sidelobe performance of an array of dipole antenna elements together with examples of geometric configuration for suppression of such post mode is described.

9 Claims, 15 Drawing Figures

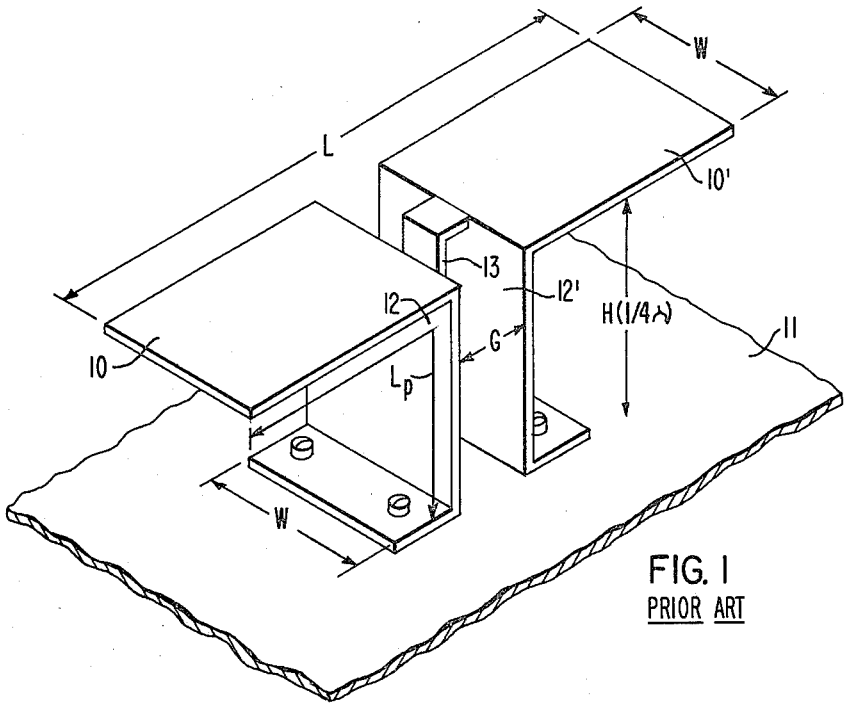
FIG. 1
PRIOR ART
FIG. 2
PRIOR ART
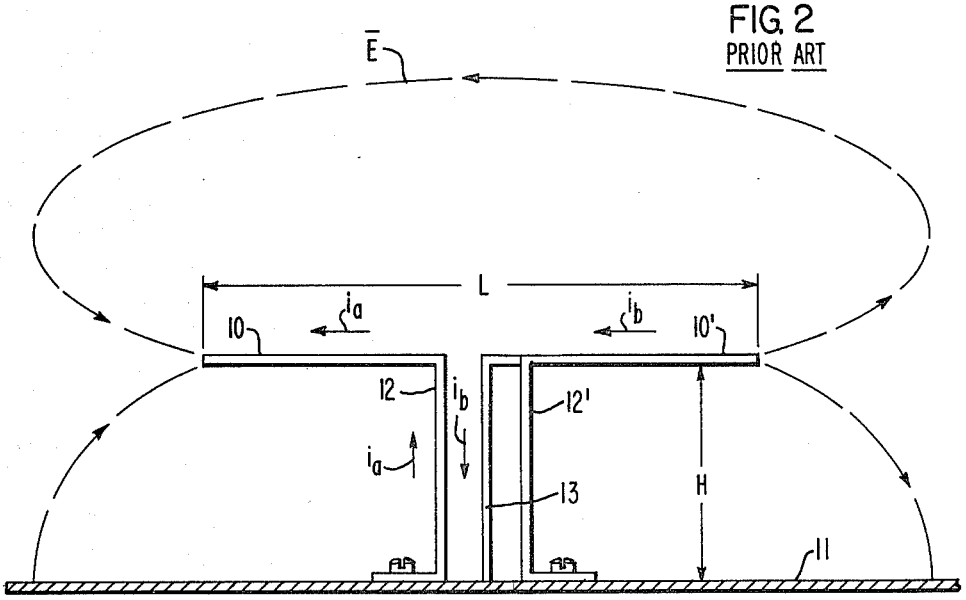

METHOD AND ANTENNA FOR IMPROVED SIDELOBE PERFORMANCE IN DIPOLE ARRAYS

BACKGROUND OF THE INVENTION

1. Field of the Invention

The present invention relates to dipole antennas, and more particularly to a method and structure for improving sidelobe performance of dipole array antennas.

2. Description of the Prior Art

Conventional dipole antenna elements such as shown in FIG. 1, comprise a length L of conductor sections 10 and 10' that are sometimes referred to hereinafter as dipole conductors, and are approximately one half of a free space wavelength (λ) long including spacing G therebetween and extend substantially in the same plane parallel to and spaced above a conducting ground plane 11 by a distance H that is approximately ¼λ. The dipole conductors 10 and 10' are held in this position each by a respective support post portion 12 and 12' respectively, which are referred to hereinafter as posts. A member 13 centered between the posts serves as the RF feedline to one of the conductors such as 10'. The dipole conductors 10 and 10' are separated by the gap G, across which the RF drive voltage is applied. Each of the dipoles 10 and 10' together with their respective support post 12 and 12' have a predetermined width dimension that extends parallel to the ground plane 11, and is referred to as W, which may be approximately 0.0012λ. Although the posts 12 and 12' are illustrated as metallic strips, they may be in the form of one half of a split tube, similar to the outer conductor of a coaxial cable. Many methods are used to supply a balanced voltage across the dipole conductors 10 and 10' and many of these methods involve transforming from an unbalanced type of transmission line such as a coaxial line or a strip transmission line, for example. Regardless of the method utilized, the objective of the drive voltage is to produce equal and opposite currents $i_a$ and $i_b$ in the two halves of such dipole conductors 10 and 10' as shown in FIG. 2 to produce a dominant (TEM) mode as represented by a vector $\overline{E}$ which radiates from the horizontal dipole conductors 10 and 10' as shown.

The conventional dipole element as described above is particularly advantageous when utilized in an array of many elements, because they inherently offer wide bandwidths, but have demonstrated unsatisfactory sidelobe performance. Where low sidelobes are desired, it is customary to utilize slotted waveguides arrays. Such slotted waveguide arrays, however, are limited in their instantaneous bandwidth.

Thus, it is desirable to be able to provide an array of dipole antenna elements that demonstrates the low sidelobe characteristics of slotted waveguide arrays, and yet maintain their wide bandwidth capability.

SUMMARY OF THE INVENTION

In accordance with the present invention, and referring to FIG. 3 we have discovered when utilizing a number of conventional dipole elements in an array, that a current may exist in the shorted posts 12 and 12' respectively. This current, which we refer to as the post current mode to distinguish it from the dominant or principal mode, is due to the coupling from neighboring dipole antenna elements of the array. This post current mode contributes to, or in other words degrades the overall antenna pattern. Such post mode pattern, is undetectable in the RF line that includes the posts 12 and 12' and the conductor 13 feeding the dipole conductors, since it is not coupled to it. As shown in FIG. 3, the post current mode is illustrated by the vectors referred to as $\overline{PE}$.

Accordingly, there is provided a method of decreasing the sidelobes of an array of dipole antenna elements by optimizing the suppression of the post mode without substantially affecting the dominant or TEM mode.

In one aspect, the present invention provides a method of suppressing the post current mode of an array by changing the geometry of each of the dipole elements to determine an optimum combination of the distance of the dipole conductors above the ground plane of the element, and the width or diameter of the post supporting the dipole conductors to effect the greatest post current impedance to provide an optimum element pattern.

In another aspect, the present invention provides a device that is utilized in determining the geometry for effecting optimum post mode suppression.

In still another aspect, the present invention provides a dipole element that provides optimum post mode suppression when used in an array.

BRIEF DESCRIPTION OF THE DRAWINGS

FIG. 1 illustrates a conventional prior art dipole antenna element having typical wide band dimensions;

FIG. 2 is a diagrammatic representation of a conventional dipole antenna element illustrating the dominant mode;

DESCRIPTION OF THE PREFERRED EMBODIMENTS

Figure 3:
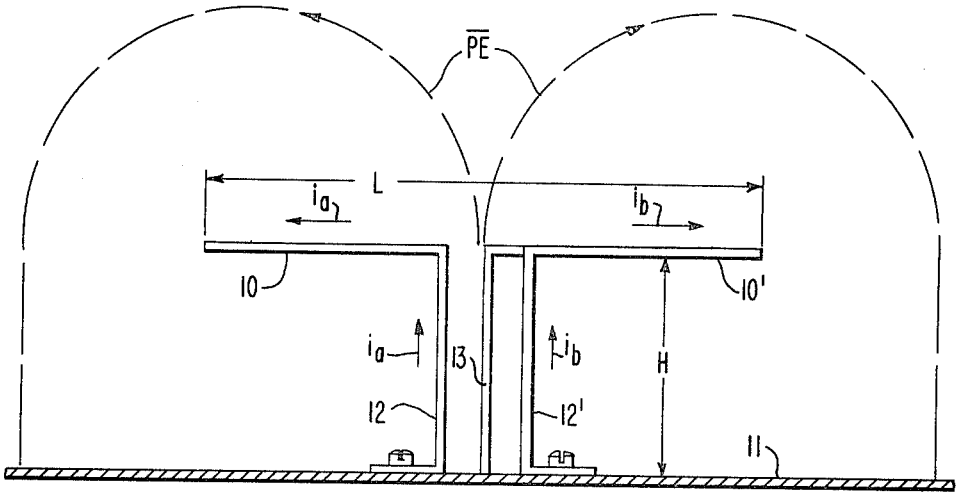
FIG. 3 is a diagrammatic representation of a conventional dipole antenna element that illustrates the current distribution and $\overline{PE}$ field of a symmetric dipole post current mode that is created by neighboring dipole antenna elements of an array.

Generally, the post mode is symmetrical in nature, as shown by $\overline{PE}$ in FIG. 3; and thus is unable to exist on the normal transverse electromagnetic (TEM) transmissions lines of the antenna feed. Since the post mode is not supported in the antenna feed circuitry, its presence is not detected in the course of measuring the feed distribution; and similarly, the post mode is unable to be compensated for in the feed circuitry. However, its presence on the dipole itself results in the radiating pattern as shown in FIG. 3 which combines with the pattern of the dominant mode as shown in FIG. 2. The dominant or TEM mode as shown in FIG. 2 is excited by the power divider of the antenna feed, and radiates from the dipole sections 10 and 10'. The spurious post mode actually has its origin in the field configuration of the dominant mode that is coupled from a neighboring dipole antenna element of the array. The dominant mode, however, has a vertical E-field component in its near field which is perpendicular to the dipole ground plane 11 and therefore propagates along it. This vertical field impinging on the support post structure 12 and 12' of neighboring dipoles, induces currents of a symmetrical nature which re-radiate the spurious symmetrical pattern of FIG. 3.

In order to suppress the post mode, consideration should be given to the lengths over which the post mode and the dominant mode are resonant. The sections 10 and 10' of the dipole may not be altered without affecting the resonant length L (FIG. 1) of the dominant mode, while a change in the distance of the dipole conductors 10 and 10' from the ground plane 11 of the antenna element alters primarily the resonant length $L_p$ (FIG. 1) of the post mode. It should be noted that changing the distance of the dipole conductors 10 and 10' from the ground plane 11 has a second order effect on pattern shape. Generally, the distance between the dipole 10 and 10' from the ground plane 11 may be decreased, if required, in the neighborhood of 60% of its standard one quarter free space wavelength (λ) distance. However, such a distance decrease from the standard quarter wavelength is a rough approximation only in order to determine the maximum alteration parameters of the dipole antenna element in accordance with the present invention.

The amount of current induced in the posts 12 and 12' by neighboring dipole antenna elements of the array is directly dependent on the impedance of the post structure. For narrow frequency bandwidths of less than 2%, for example, conventional dipole antenna elements and their support posts are usually narrow conductors that are about $\frac{1}{2}\lambda$ and $\frac{1}{4}\lambda$ in length respectively. For such narrow frequency bandwidths, the impedance in the post or support portion of the dipole is relatively high and thus the current is low over the narrow band. However, for wider band designs the impedance is relatively low and the current is relatively high. Thus, a conventional dipole antenna element for a wide band application of 2% or above tends to experience large currents $i_a$ and $i_b$ in the posts and causes significant degradation.

Figure 6:
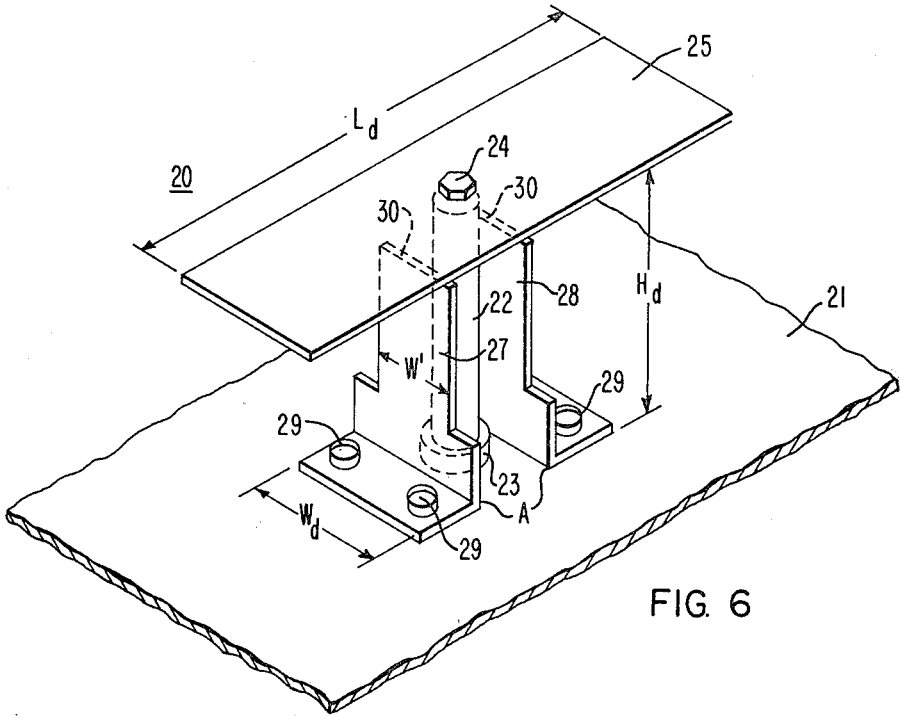
FIG. 6 is a three-dimensional view of the device of FIGS. 4 and 5 to illustrate a typical configuration after optimum suppression of the post mode.
Figure 4:
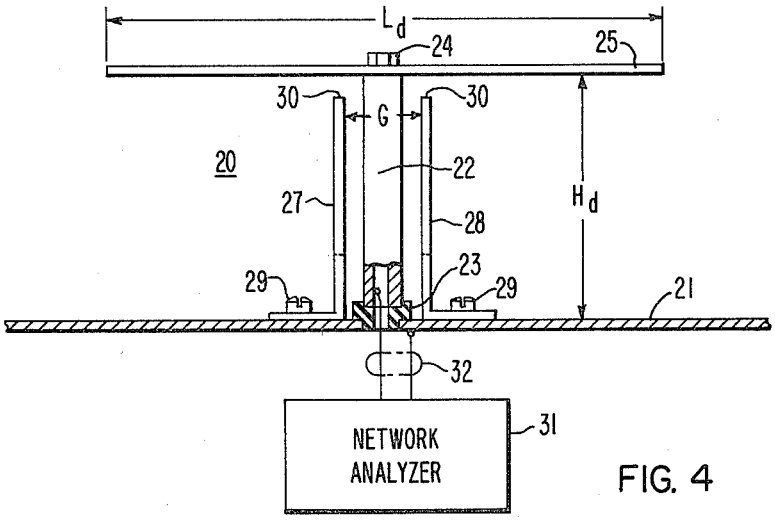
FIGS 4 and 5 illustrate front and side views in elevation of a device for determining the proper geometry of a dipole antenna element for effecting optimum suppression of the post mode.
Figure 5:
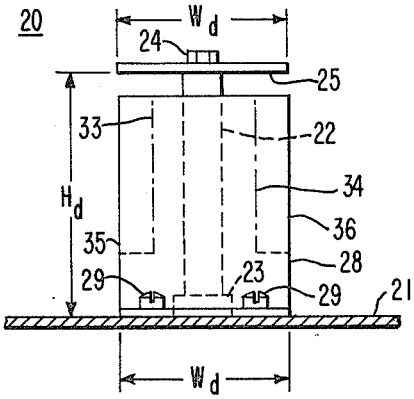

In order to alter the geometry of a dipole antenna element that is to be used in an array to provide optimum post mode suppression, we have provided a device referred to as 20 in FIGS. 4, 5, and 6 for simulating the amount of current that would be induced in the posts of the element by a neighboring dipole antenna element of an array.

With reference to FIGS. 4 and 5, the device 20 comprises a piece of sheet metal 21 that simulates the ground plane for the dipole element to be modified. A post member 22 is fastened at its one end by a bushing of insulating material 23 to the sheet 21 to extend upwardly as viewed in FIGS. 4 and 5 perpendicular to the surface of the ground plane 21. The post 22 has an upper or outer end portion to which is fastened by a screw 24 a thin conductive member 25 that is substantially rectangular in configuration. The member 25 has a length $L_d$ and a width $W_d$ that corresponds initially to the length L and the width W of the dipole element being simulated such as that shown in FIG. 1, for example. The post 22 is of a selected length to support the member 25 substantially parallel to the plane of the member 21 the same distance H ($\frac{1}{4}\lambda$) as the dipole antenna element being simulated. A pair of L-shaped members 27 and 28 are connected rigidly and conductively at one end to the sheet metal member 21 by any suitable means such as screws 29 for example; and are positioned so that one leg of each of the members 27, 28 is disposed on opposite sides of the post 22. Each of the members 27 and 28 are spaced from the post 22 and each other a distance such that the total spacing between the posts 27, 28 is the same as the space G between the dipole halves 10 and 10', and the posts 12 and 12' of the element being simulated. The portion of the members 27 and 28 which are spaced from and extend parallel to the axis of the post 22 are of such a length that each of their upper edges 30 are spaced from the underside of the member 25 approximately 10% of the total distance between the member 25 and the ground plane 21, which dimension is referred to as $H_d$. A conventional network analyzer or voltage standing wave ratio meter (VSWR) 31 (FIG. 4) is electrically connected to the sheet metal member 21 and the post 22 by a conventional RF connector 32.

In determining the geometry of a dipole antenna element to effect optimum suppression of the post mode, the actual element should be first constructed in a conventional manner to have the desired principle mode impedance, and to utilize the minimum width or the diameter, as the case may be, of a support post such as 12 and 12' that is consistent with the structural and feedline requirements of the elements of the array. Once such an antenna element as shown in FIG. 1 has been constructed, then the device 20 as described in connection with FIGS. 4 and 5 should be structured such that the space H between the sheet metal member 21 and the member 25 is the same distance as the ground plane 11 spacing of the dipole portion 10, 10' of the antenna element, which for a conventional dipole is $\frac{1}{4}\lambda$. Also, as previously mentioned the sheet metal member 25 should have the same length ($L=L_d$) as the two halves of the dipole element together with the gap G therebetween, and be of the same width ($W=W_d$). Also, the width $W_d$ of the members 27 and 28 should be of the same width $W_d$ as the support post of the dipole antenna element under consideration.

Once the device 20 has been constructed as previously described, the network analyzer 31 is activated to measure its impedance as a function of frequency. Then, the post 22 may be shortened in one or more increments to decrease the distance between the member 25 and the sheet metal member 21, (from $\frac{1}{2}\lambda$), until the maximum impedance measured by the network analyzer is reached. For every incremental shortening of the post 22, the outer conductors or posts 27 and 28 are shortened to maintain substantially the same distance between their edges 30 and the member 25. The distance $H_d$ should not be decreased to the extent that the dominant TEM mode is degraded. In the event that the distance $H_d$ between the member 25 and the ground plane 21 is insufficient to provide the desired dominant mode, the width $W_d$ of the members 27 and 28 are decreased in one or more increments, preferably throughout a portion of their length. Such a decrease is effected, for example, by removing a portion of the metal from the members 27 and 28, such as the area between alternately long and short dashed lines 33 and 34 and the outer edge 35 and 36 respectively, such as shown in FIG. 5. Thus, the members 27 and 28 each have a more narrow portion adjacent their respective upper edge 30. This narrowing throughout a portion of its length or in other words stepping the width of the members 27 and 28, further increases the impedance without decreasing the distance between the member 25 and the ground plane 21 to a point where there is a deleterious effect on the dominant mode.

Once the impedance has been peaked as previously described, the individual dipole element (FIG. 1) is then configured so that the ground plane distance between the dipole conductors 10 and 10' and the ground plane 11 are modified to equal the distance between the member 25 and the metal sheet 21 of the device 20. The posts as modified for each of the dipole sections 10 and 10' are then configured to have the same geometry and width dimensions W as the modified widths of the members 27 and 28 respectively.

Referring to FIG. 6, which shows the device 20 after being modified utilizing the method previously described, and bears the same reference numerals and designations for corresponding parts as FIGS. 4 and 5, illustrates an example of how the resulting device 20 may appear after maximum impedance of the post mode has been reached for a particular dipole element. In discussing the theory of the method of the present invention, assume that the members 27 and 28 have a length dimension D such that their top edges 30 actually engage the under side of the member 25. These, "outer conductors" 27 and 28 would then become part of the horizontal top of the device 20. A vertical field impinging on the device 20 would thus induce currents on the outer conductors 27 and 28 if the total of one-half of length $L_d$ plus length $H_d$ were about one half of a wavelength long. Near the base of the L-shaped members 27 and 28, at point A, the two conductors 27 and 28 simulate the outer conductors 12 and 12' (FIG. 1) in the actual dipole element, as well as a balun. These members 27 and 28 are shorted together since they are conductively attached to the common ground plane 21. The impedance seen by the vertical field at this point A is therefore zero. A quarter of a free space wavelength from point A along the axis of the members 27 and 28 adjacent to member 25, the impedance increases to a maximum and will approach an open circuit. If the impedance at this quarter wavelength point could indeed be made to be infinite, then the currents flowing in the post portion 27, 28 that is perpendicular to the ground plane of the actual dipole would be completely suppressed and the spurious post mode thus would not be supported. In reality, the degree to which the post mode is suppressed is determined by the degree to which the post impedance can be made to approach an open circuit. It is, however, not possible to measure the impedance that is seen a quarter of a wavelength from the point A by the post mode, since the mode is not supported in the TEM transmission lines common to conventional microwave test equipment. However, the determination of the actual absolute value of the impedance is not necessary; only maximization is desired. While the impedance seen by the post mode may not necessarily be equal to that seen by the dominant (TEM) mode, it is nevertheless assured that the impedance has been maximized to the post mode as long as it has been maximized to the TEM mode. If the outer conductors 27 and 28 actually extended to the member 25, the TEM mode would see a short circuit, and the impedance at the one quarter of wavelength distance from point A would not vary in accordance with the height $H_d$ or the width $W_d$. Therefore, there could not be an indication of the impedance that would be seen by the post mode at a distance $\frac{1}{4}\lambda$ from point A toward the member 25. However, with a gap existing between the edge 30 of each of the members 27 and 28 and the member 25, the TEM impedance at that point can then be monitored as a function of the distance $H_d$ and the width $W_d$ to permit maximization of such impedance. Maximization of the measured TEM impedance, then implies maximization of the unmeasured spurious mode post impedance.

Finally, with respect to the changes in geometry that are needed for post mode suppression, it should be noted that there is a limit to which the ground plane spacing H can be shortened before deleterious effects on the dominant mode occur. Thus, in order to electrically shorten such distance without physically shortening $H_d$, a step in impedance from a low Z to a high Z in the section of the transmission line represented by the members 27 and 28 is used to rotate one "backward" i.e., toward the generator on the conventional well-known Smith Chart so that $H_d$ appears shorter electrically than it actually is physically. The location where the transistion in width from $W_d$ to W occurs as shown in FIG. 6 is not critical. The width W' generally must be made as narrow as possible up to the limit that is determined by two factors. First, the need for sufficient mechanical support, and then the need for sufficient width so that the width W' can still function as an outer conductor for the TEM transmission line of the dominant mode. The height $H_d$ generally should be decreased from the normal value of $\frac{1}{4}\lambda$ because the impedance transformation does not generally shorten $H_d$ sufficiently. In shortening $H_d$, it must be kept in mind that the element pattern is also being changed somewhat. In some instances, it may be desirable to monitor the pattern and utilize an iterative process to determine an optimum combination of the dimensions of H, the width W', the post mode impedance that is determined by the network analyzer and the element pattern.

Figure 7A:
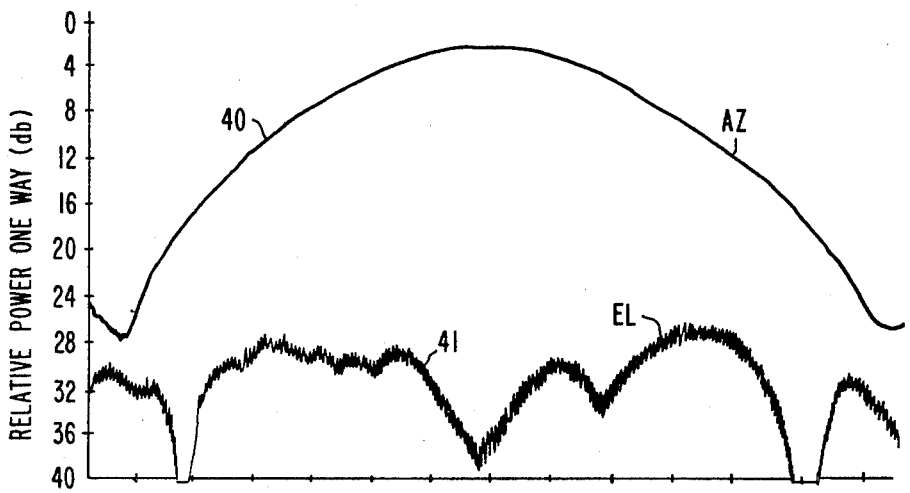
FIGS. 7A, 7B and 7C are graphical schematic illustrations respectively, showing the patterns taken in a conventional anechoic chamber to show evidence of the presence of the post mode.
Figure 7C:
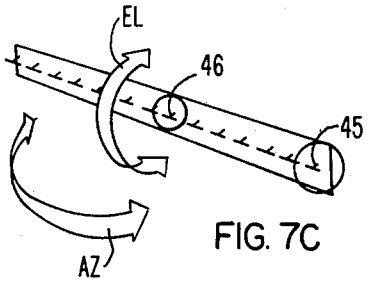
Figure 7B:
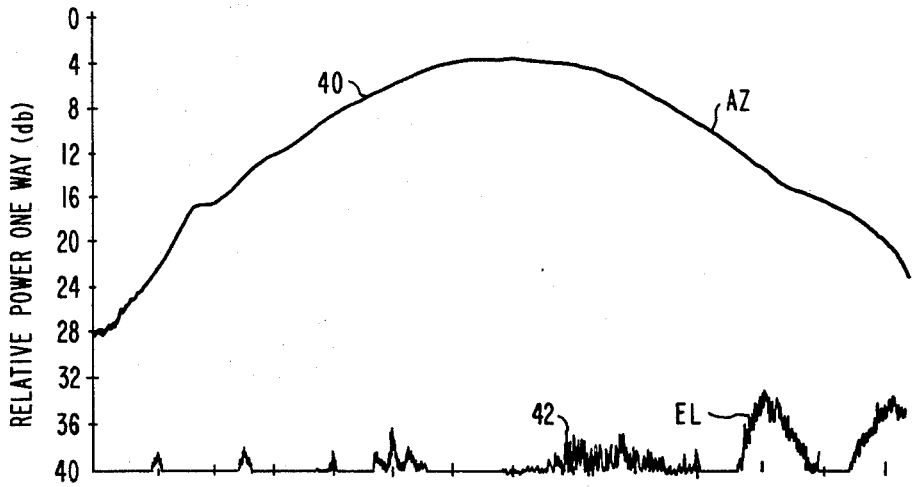

The existence of the post mode is illustrated by the diagrams of FIGS. 7A, and 7B, for an array diagrammatically shown at 7C, which illustrate pattern tests taken in a conventional anechoic chamber. The antenna under test (FIG. 7C) was a linear array containing fourteen dipole elements that were spaced approximately 6.99 inches apart and were designed in accordance with the method of the present invention. The tests were first taken at 1,000 MHz which deviated from the design frequency of 1300 MHz for the array, to demonstrate the existence of the post mode. The set of patterns as shown in FIG. 7A is that of an outer or end element, such as 45 of FIG. 7C of the array. Note that azimuth (AZ) pattern 40 is a typical pattern of a dipole that is oriented horizontally over a ground plane. A cross-polarized pattern referred to as 41 was taken on the elevation plane (EL) with such pattern evidencing a vertical monopole over ground. The pattern 41 in FIG. 7A is the pattern of the currents radiating from the support post of the dipole element 45. The set of patterns of FIG. 7B, are those of a center element 46 of the fourteen-element linear array and are also at 1000 MHz. A pattern of the post mode such as 41 in FIG. 7A would be expected, except that for a dipole near the center of the array, any post modes from dipole elements on either side of the center element 46 tend to cancel at the center and thus the level of the post mode pattern 42 in FIG. 7B is considerably lower than the pattern 41 for the outer element 45 of the array as shown in FIG. 7A. If such array were scanned however, the cancellation would not occur for the center element 46.

At the design frequency of 1,300 MHz where the post mode is suppressed, a curve such as 42 of FIG. 7B was obtained when taken on the elevation plane for all of the elements thus showing no evidence of such a monopole pattern.

Figure 8:
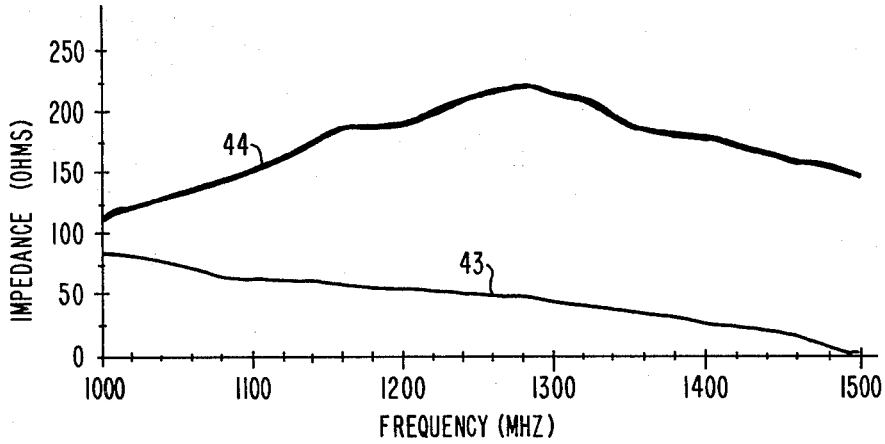
FIG. 8 is a graphic illustration of the maximization of the impedance seen by the post mode utilizing the device similar to that of FIG. 6.

Referring to FIG. 8, a curve 43 shows the impedance seen by the post mode for the device 20 prior to maximization of the post impedance for an element designed for approximately 1300 MHz. Curve 44 illustrates the final values of the impedance after optimization of the geometry of the device, such as is shown in FIG. 6.

Figure 10:
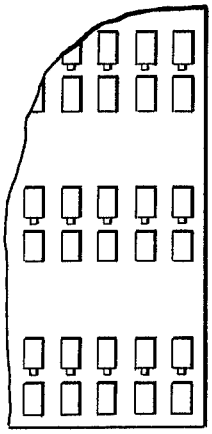
FIG. 10 is a fragmentary view of an array of dipole elements.
Figure 9:
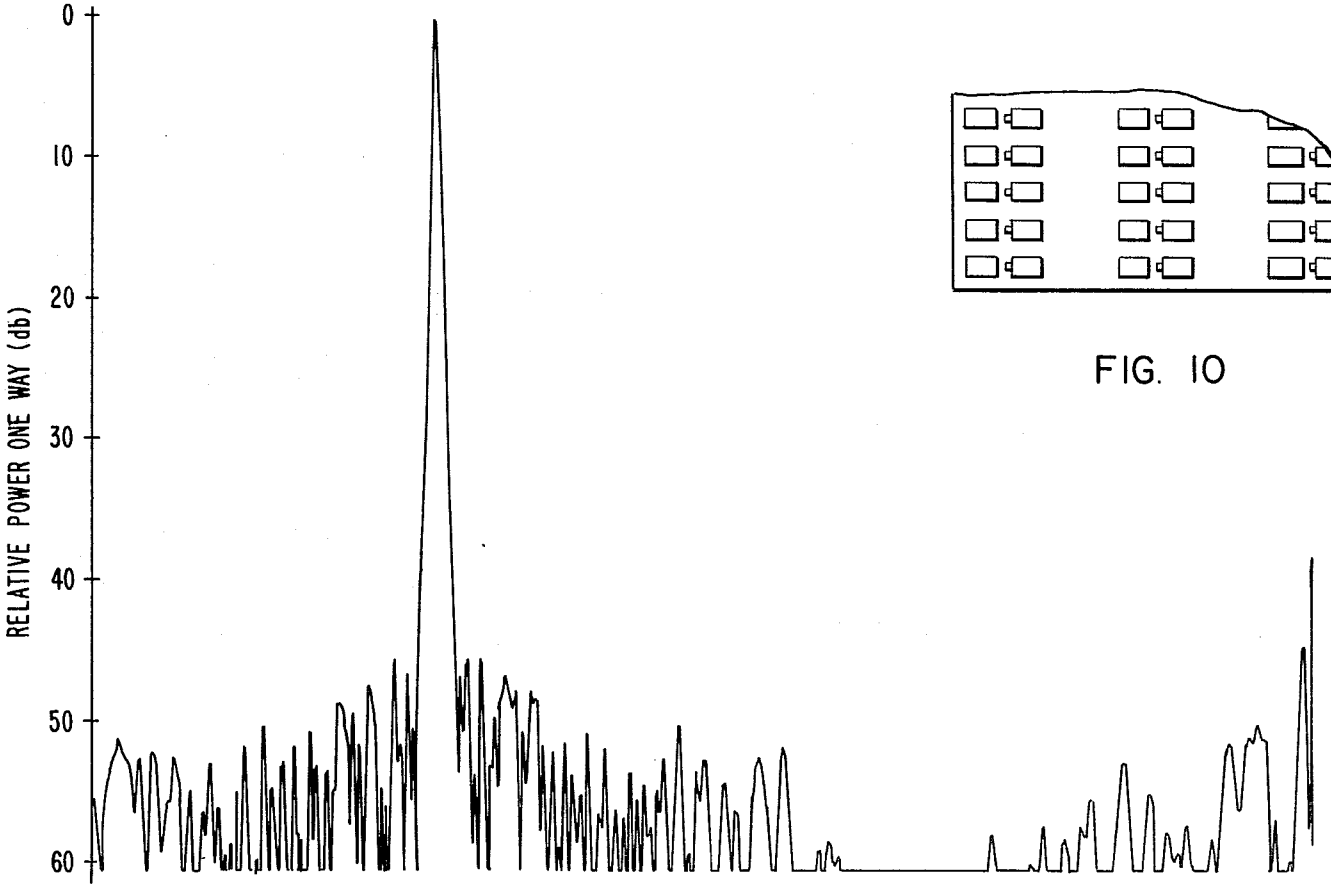
FIG. 9 is a graph of the pattern of an array of dipole elements constructed in accordance with the present invention to show sidelobe performance.

In accordance with the geometry and dimensions determined by the device 20, FIG. 9 shows a pattern that was obtained by an array of individual dipole antenna elements such as shown fragmentarily in FIG. 10 that were used in an L-band radar. Each of the dipole elements were designed to suppress the post mode in accordance with the method of the present invention.

Figure 13:
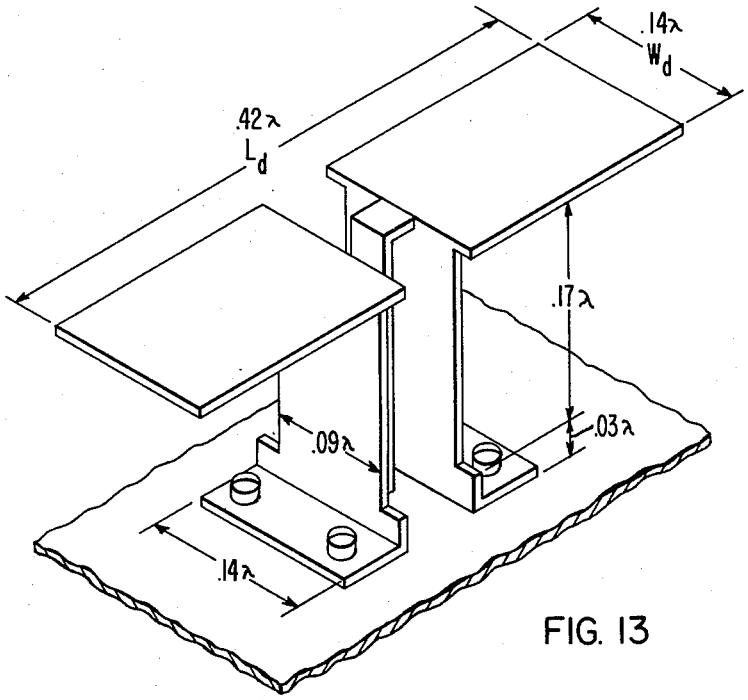
FIGS. 11, 12 and 13 each illustrate a different dipole element having a geometry that was determined in accordance with the present invention.
Figure 11:
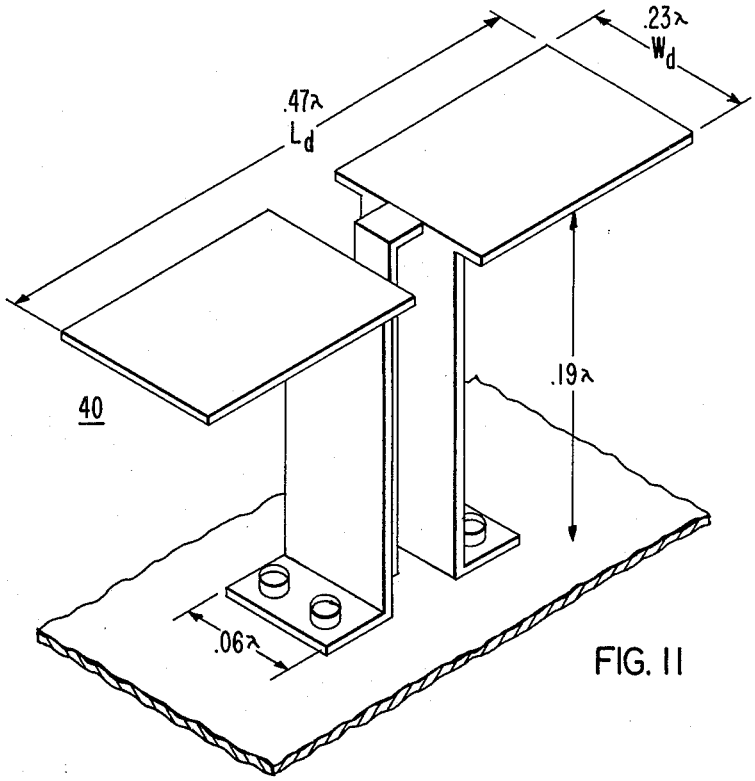
Figure 12:
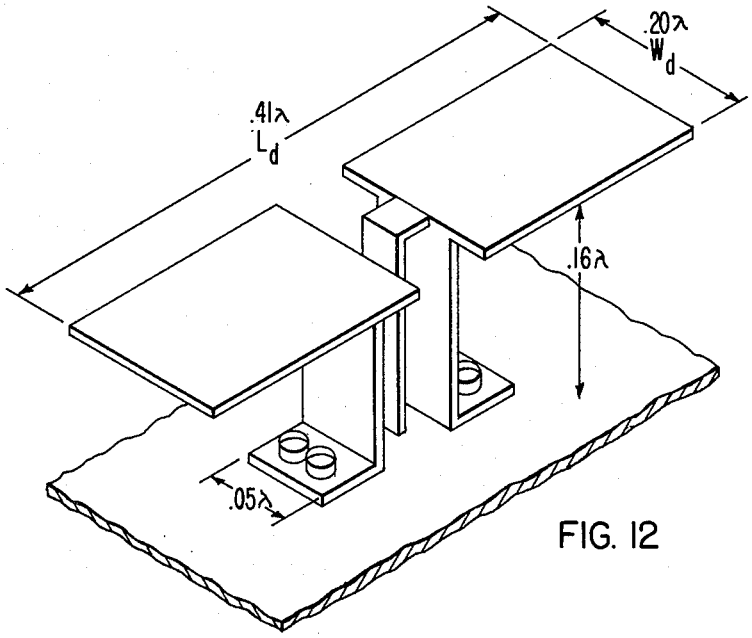

Some examples of typical dipole antenna elements that were designed according to the present invention; and utilizing the device and the method of the present invention and which had been shown to be effective in the suppression of the post mode with the resultant decrease in sidelobes, are illustrated in FIGS. 11 through 13. For example, FIG. 11, illustrates a resulting dipole element having a dipole conductor height of substantially 0.19λ above the ground plane and a post width of approximately 0.06 of a free space wavelength. Such an element was effective in a 512 element array having a center frequency of 1,300 MHz. FIG. 12 according to another example for a slightly lower center frequency shows an element having a distance between the dipole conductor and the ground plane which is approximately 0.16λ together with a post width of approximately 0.05λ. FIG. 13 is another example of a dipole element having a ground plane a total distance of 0.2λ from the dipole conductor with a post width of 0.14λ that has been stepped approximately 0.03λ from the ground plane to the resulting narrow width of 0.09λ. This element was used in a 14 element linear array for a center frequency of 1,300 MHz. It is noted that the lengths $L_d$ on width $W_d$ of the dipole conductor may differ as shown in FIGS. 11 through 13, but as previously mentioned, such dimensions are selected for consideration other than the optimization of post mode suppression.

In summary, there has been described the discovery of the existence of a dipole spurious post mode of dipole antenna elements utilized in the array which has been responsible for the heretofore poor sidelobe performance of dipole arrays. In connection with this discovery a mechanism and a method for suppression of such a mode as well as examples of improved dipole elements together with experimental results that have been obtained, have been set forth with arrays of such elements showing a very significant improvement in antenna sidelobe performance. Although the dipole elements are described and illustrated as having posts with flat surfaces, it is understood that such posts may be curved or arcuately shaped in the width dimension. It is understood that various modifications may further be made in the device 20 and the method of optimizing the suppression of the post mode all without departing from the spirit or scope of the invention as set forth in the appended claims.

We claim:

1. A method of determining the geometry of the individual elements of an array of dipole antenna elements to decrease the sidelobes thereof wherein each of the elements includes a pair of dipole conductors extending substantially parallel to a metallic ground plane and a conductive post extending substantially perpendicular to the ground plane to support each of the conductors a predetermined distance from the ground plane, said method comprising utilizing a structure that includes a conductive ground plane with a pair spaced opposing planar conductors conductively attached at one end to the ground plane and extending perpendicular therefrom to terminate at their outer ends a selected distance from a planar conductive member that is insulatively mounted substantially parallel to and spaced a selected distance from the ground plane and the outer ends of the pair of conductors, connecting a network analyzer across the ground plane and the conductive member, selecting the distance between the ground plane and the conductive member while maintaining the spacing between said member and the outer ends of the conductors to maximize impedance without substantially degrading the dominant TEM mode, and constructing each dipole antenna element of the array to conform to the selected dimensions of the utilized structure.

2. A method according to claim 1 further comprising selecting the width of the conductors over at least a portion of their length, to maximize the impedance over a selected bandwith.

3. A method according to claim 1 wherein the step of selecting the distance between the conductive member and the ground plane includes a selection that is less than one quarter of a free space wavelength and at least a distance of 0.15 of a free space wavelength.

4. A method according to claim 2 wherein the step of selecting the width includes a selection that provides a narrowed width of the conducting members over a portion of their length commencing a predetermined distance from the ground plane to increase the impedance from the ground plane to the conductive member.

5. An array of dipole antenna elements that is designed to radiate energy over a bandwidth that deviates at least 2% from a selected center frequency, each of said elements comprising a metallic ground plane, a pair of spaced dipole conductors having a geometric configuration and dimension for irradiating energy over said bandwidth, a post conductor having a selected length dimension for supporting the dipole conductors a selected distance from the metallic ground plane, and a selected width dimension that extends perpendicular to the length dimension for providing adequate support and for conducting radiant energy to the dipole conductors, said length dimension being selected in accordance with the distance at the measured maximum impedance without substantial degradation of the dominant TEM mode of a planar conductive member and a metallic plate wherein the member is insulatively mounted substantially parallel to the plate and a pair of spaced conductors are attached at one end to the plate and extend toward the planar conductive member a predetermined distance to optimize suppression of a post mode caused by radiant energy of neighboring dipole elements of the array without adversely affecting the dominant TEM mode.

6. An array according to claim 5 wherein the pair of dipole conductors for each antenna element extend over the ground plane a predetermined length and have a selected width dimension perpendicular to said length dimension, said width dimension of each post conductor being selected throughout at least a portion of its length in accordance with the width dimension of the spaced conductors at the measured maximum impedance, and wherein the selected width dimension of each post conductor is less than the width dimension of the dipole conductors.

7. An array of antenna elements according to claim 5 or 6 wherein each post conductor of each dipole element of the array has a selected width dimension that is less throughout a portion of its length.

8. An array according to claim 5 wherein the selected length dimension is 0.16 of a free space wavelength and the selected width dimension is 0.06 of a free space wavelength.

9. An array according to claim 5 wherein the selected length dimension is substantially 0.20 of a free space wavelength and the selected width dimension is substantially 0.09 of a free space wavelength for a portion of its length and substantially 0.14 of a free space wavelength throughout the remaining portion of its length.

* * * * *